US010221469B2

(12) United States Patent
Aruga et al.

(10) Patent No.: US 10,221,469 B2
(45) Date of Patent: Mar. 5, 2019

(54) ALUMINUM ALLOY PLATE FOR FORMING

(71) Applicant: KOBE STEEL, LTD., Kobe-shi (JP)

(72) Inventors: Yasuhiro Aruga, Kobe (JP); Katsushi Matsumoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 194 days.

(21) Appl. No.: 14/425,943

(22) PCT Filed: Oct. 16, 2013

(86) PCT No.: PCT/JP2013/078079

§ 371 (c)(1),
(2) Date: Mar. 4, 2015

(87) PCT Pub. No.: WO2014/065175

PCT Pub. Date: May 1, 2014

(65) Prior Publication Data

US 2015/0252453 A1 Sep. 10, 2015

(30) Foreign Application Priority Data

Oct. 23, 2012 (JP) ..... 2012-233716

(51) Int. Cl.

| | |
|---|---|
| ***C22C 21/08*** | (2006.01) |
| ***C22C 21/06*** | (2006.01) |
| ***C22F 1/00*** | (2006.01) |
| ***C22F 1/047*** | (2006.01) |

(52) U.S. Cl.
CPC ..... *C22C 21/08* (2013.01); *C22C 21/06* (2013.01); *C22F 1/00* (2013.01); *C22F 1/047* (2013.01)

(58) Field of Classification Search
CPC . C22C 21/06; C22C 21/08; C22F 1/00; C22F 1/047
USPC ..... 420/532
See application file for complete search history.

(56) References Cited

U.S. PATENT DOCUMENTS 5,441,582 A * 8/1995 Fujita ..... C22F 1/047 148/418

FOREIGN PATENT DOCUMENTS

| | | | | |
|---|---|---|---|---|
| CN | 102373353 | A | | 3/2012 |
| CN | 102453821 | A | | 5/2012 |
| CN | 102994825 | A | | 3/2013 |
| JP | 2-118049 | A | | 5/1990 |
| JP | 07-224364 | | | 8/1995 |
| JP | 2006-249480 | | | 9/2006 |
| JP | 2010-077506 | | | 4/2010 |
| JP | 2011-038136 | | | 2/2011 |
| JP | 2012-52220 | A | | 3/2012 |
| JP | 2012-107316 | A | | 6/2012 |
| JP | 2012140709 | A | * | 7/2012 |
| JP | 2013-60628 | A | | 4/2013 |

OTHER PUBLICATIONS

NPL: Machine translation of JP 2011-038136A, Feb. 2011.*
NPL: Machine translation of JP 2012-107316A Jun. 2012.*
NPL: Machine translation of JP 2012-140709A Jul. 2012.*
International Search Report and Written Opinion dated Jan. 7, 2014 in PCT/JP2013/078079 filed Oct. 16, 2013.

* cited by examiner

*Primary Examiner* — Jie Yang
(74) *Attorney, Agent, or Firm* — Oblon, McClelland, Maier & Neustadt, L.L.P.

(57) ABSTRACT

Provided is an Al—Mg alloy plate for molding, having excellent press formability, little stretcher strain (SS) mark generation, and not generating any new issues such as reduced bending properties as a result of age-hardening at room temperature, while using more accurate and simple structural indicators. As a result, the Al—Mg aluminum alloy plate comprising a specific composition including Cu has a plate structure having an average particle diameter of 0.5-6.0 nm in a minute particle (cluster) particle distribution measured using an X-ray scattering method, controls the volume fraction to at least 0.03%, is unlikely to have serration, and suppresses SS mark generation during press forming.

12 Claims, No Drawings

ALUMINUM ALLOY PLATE FOR FORMING

TECHNICAL FIELD

The present invention relates to an Al—Mg alloy sheet having good formability. In the invention, an aluminum alloy sheet includes a hot-rolled sheet and a cold-rolled sheet, and refers to an aluminum alloy sheet subjected to heat treatments such as solution treatment or hardening treatment. Hereinafter, aluminum may be represented as Al.

BACKGROUND ART

Recently, a social demand for weight saving of vehicles such as motorcars has increased more and more out of consideration for the global environment. To meet such a social demand, aluminum alloy materials are investigated in place of steel materials such as steel sheets as materials for auto panels, particularly large body panels (outer panels and inner panels) such as panels for a hood, a door, and a roof.

The Al—Mg (5000-series aluminum) alloy sheet (hereinafter, sometimes referred to as Al—Mg alloy sheet) including JIS 5052 alloy and JIS 5182 alloy has high ductility and strength, and therefore has been used as a material for forming (press forming) for such large body panels.

However, as disclosed in PTL 1 and the like, when such an Al—Mg alloy sheet is subjected to a tensile test, yield elongation may occur in the vicinity of the yield point on a stress-strain curve, or saw-toothed or stepwise serrations may occur on the stress-strain curve at a relatively large amount of strain (for example, tensile elongation of 2% or more) beyond the yield point. Such phenomena on the stress-strain curve cause so-called stretcher strain (hereinafter, sometimes represented as SS mark), leading to a significant problem that reduces commercial value of the large body panel as a forming product, particularly of the outer panel the appearance of which is a commercially important factor.

As generally known, the SS mark is classified into two types, i.e., a so-called random mark as an irregular beltlike pattern such as a flame pattern formed in a region of a relatively small amount of strain, and a parallel band as a parallel beltlike pattern formed so as to define about 50° with respect to a tension direction in a region of a relatively large amount of strain. It is known that the former (a first type) random mark is caused by yield point elongation, and the latter (a second type) parallel band is caused by the serrations on the stress-strain curve.

There have been provided various methods for preventing such types of SS mark. For example, as a main approach, it has been known that particles of the Al—Mg alloy sheet are controllably coarsened to a certain degree. However, such an approach of particle control is not effective for preventing formation of the parallel band as the second type of the SS mark. If the particles are excessively coarsened, another problem such as surface roughening is rather caused during press forming.

As another approach for preventing the SS mark, it has also been known that a refined material of the Al—Mg alloy sheet is subjected to working (pre-working) such as skin-pass or leveling before being press-formed into the large body panel so that a slight strain (pre-strain) is added thereto. Even in such a pre-working approach, if the material is too highly worked, the serrations on the stress-strain curve are likely to occur, easily leading to formation of a wide and clear parallel band during actual press forming.

In contrast, PTL 1 provides a method of manufacturing the Al—Mg alloy sheet, in which formation of both the random mark and the wide parallel band is suppressed. In such a method, a rolled sheet of the Al—Mg alloy is subjected to solution treatment and hardening treatment, and is then subjected to cold working as pre-working followed by final annealing, and thereby a sheet with an average particle size of 55 μm or less and without coarse particles is produced.

PTL 2, which makes no direct description on suppression of SS mark formation, describes that a heating curve from room temperature is obtained through measurement of thermal variation of an alloy sheet by differential scanning calorimetry (DSC), and a position and a height of an endothermic peak on the heating curve are used as guidelines for improving press formability of the alloy sheet.

However, a demand level for a surface texture becomes strict more and more in a recent large body panel, particularly in an outer panel the appearance of which is a commercially important factor. In each of PTLs 1 and 2, the measure to suppress the SS mark formation is not enough to meet such a demand.

In contrast, as exemplified in PTL 3, there is provided a technique in which 0.1 to 4.0% of Zn is particularly contained in the Al—Mg alloy sheet, and thereby the amount of clusters (ultrafine intermetallic compounds) formed by Al and Mg is increased as clusters that each further include Zn, so that the critical strain amount (limit strain amount) for serrations is increased, and the effect of increasing the limit strain amount is further enhanced. It is described that this makes it possible to suppress formation of both the random mark and the parallel band, and it is possible to produce an Al—Mg alloy sheet that is suppressed in SS mark formation and good in formability such as press formability into an auto panel.

PTL 4 defines an average particle diameter in particle size distribution determined by a small-angle X-ray scattering method and average number density of peak sizes in the particle size distribution, as guidelines for indicating a relationship between the microstructure of an Al—Mg alloy sheet that also contains Zn and press formability represented by the SS mark or the like.

However, when the Al—Mg alloy sheet contains a large amount of Zn, another issue arises, i.e., age hardening at room temperature tends to occur. This is because while PTL 3 describes the clusters (ultrafine intermetallic compounds) including Zn as the best measure to suppress SS mark formation, such clusters are easily formed at room temperature.

In general, the Al—Mg alloy sheet is not formed into a product such as a large body panel by an automaker immediately after being manufactured by an aluminum sheet manufacturer, but is formed into the product some weeks later after that. Hence, for example, when the Al—Mg alloy sheet is formed into a product such as a large body panel after the lapse of one month from manufacturing of the sheet, age hardening proceeds, and a new (another) issue arises, i.e., bendability or press formability is rather degraded.

As generally known, age hardening at room temperature is in general less likely to occur in the Al—Mg alloy sheet compared with a heat-treated Al—Zn—Mg (7000-series) alloy sheet. However, when such an Al—Mg alloy sheet has a high content of Zn as in PTL 3, the sheet also shows age hardening at room temperature as with the 7000-series aluminum alloy sheet.

In contrast, PTLs 5 and 6 each devise a technique in which Cu is contained in the Al—Mg alloy sheet as an element effective for suppressing SS mark formation, in place of Zn that tends to cause age hardening at room temperature. However, even if an Al—Mg alloy sheet contains Cu, the sheet may not exhibit the effect of suppressing SS mark formation. Specifically, a formation state of the SS mark is greatly affected by an existing state (a microstructural state) of Cu in the Al—Mg alloy sheet.

In PTL 5, therefore, the microstructure of the sheet is indirectly defined by the endothermic peaks between 180 and 280° C. on a heating curve (DSC heating curve) from room temperature determined by differential thermal analysis (DSC).

In PTL 6, the microstructure of the sheet is more directly defined by average density of clusters including Cu atoms, each Cu atom being in specific connection with other Cu atoms adjacent thereto, in atomic clusters determined by a three-dimensional atom probe field ion microscope.

CITATION LIST

Patent Literature

PTL 1: Japanese Unexamined Patent Application Publication No. Hei7 (1995)-224364
PTL 2: Japanese Unexamined Patent Application Publication No. 2006-249480
PTL 3: Japanese Unexamined Patent Application Publication No. 2010-77506
PTL 4: Japanese Unexamined Patent Application Publication No. 2011-38136
PTL 5: Japanese Unexamined Patent Application Publication No. 2012-52220
PTL 6: Japanese Unexamined Patent Application Publication No. 2012-107316

SUMMARY OF INVENTION

Technical Problem

However, even if Cu is contained in the Al—Mg alloy sheet for the effect of suppressing SS mark formation, there still remains an issue of more accurately and more simply determining the existence state of clusters of the fine Cu atoms (Cu clusters) in correlation with the SS mark characteristic despite the techniques of PTLs 5 and 6.

An object of the invention is therefore to provide an Al—Mg alloy sheet for forming that is suppressed in SS mark formation without causing the issues such as age hardening at room temperature under more accurate and simpler microstructural guidelines, and is thus improved in press formability into auto panels.

Solution to Problem

To achieve the object, an aluminum alloy sheet for forming according to the invention is summarized in that the aluminum alloy sheet includes an Al—Mg alloy sheet containing, by mass percent, Mg: 2.0 to 6.0%, and Cu: more than 0.3% and 2.0% or less, with the remainder consisting of Al and inevitable impurities, and an average particle diameter in particle size distribution determined by a small-angle X-ray scattering method is 0.5 to 6.0 nm, and the volume fraction of the particles is 0.03% or more.

Advantageous Effects of Invention

According to the findings of the inventors, for the Al—Mg alloy sheet containing Cu, particle size distribution (average particle diameter and volume fraction) of particles (Cu clusters) of nanometer-order or less determined by a small-angle X-ray scattering method indicates the existing state of the particles, and is in correlation with the SS mark characteristic. In other words, the inventors have found that, for the Al—Mg alloy sheet containing Cu, the particle size distribution determined by the small-angle X-ray scattering method can be a guideline for indicating the relationship between the microstructure of the sheet and the press formability typified by the SS mark characteristic of the sheet.

The small-angle X-ray scattering method has been known in the past as a typical technique for investigating information of a nanometer-order structure (microstructure). When a substance is irradiated with X-rays, the incident X-rays reflect the information of electron density distribution in the inside of the substance, and scattered X-rays are generated around the incident X-rays. For example, if the substance contains an uneven region of particles or the electron density, scattering occurs around the incident X-rays.

According to this principle, when an aluminum alloy microstructure contains particles of nanometer-order or less, scattering occurs around the incident X-rays. The small-angle X-ray scattering method makes it possible to accurately and simply obtain information of the particles of nanometer-order or less, such as a shape, size, and distribution, through analysis of the scattered X-rays. Consequently, the invention can reproducibly control the microstructure of the Al—Mg alloy sheet containing Cu in terms of the particle size distribution so that serrations are less likely to occur and SS mark formation can be suppressed.

DESCRIPTION OF EMBODIMENTS

Hereinafter, an embodiment of the invention is specifically described on each of requirements.

(Microstructure)

The invention defines the particle size distribution (average particle diameter and volume fraction) of all (total amount of) particles, which can be determined by the small-angle X-ray scattering method, not depending on compositions in the microstructure of the Al—Mg alloy sheet having a composition containing Cu. Hereinafter, such particles may be referred to as atomic cluster. The inventors have beforehand grasped that the particles defined in the invention generally include aggregates of Cu atoms (clusters of Cu atoms, i.e., Cu clusters) by an atom probe method different from the small-angle X-ray scattering method. Hence, the particles, of which the particle size distribution and the volume fraction are determined or derived by the small-angle X-ray scattering method, may be generally regarded as the clusters of Cu atoms (Cu clusters).

However, the inventors have found that the particle size distribution (average particle diameter and volume fraction) of all (total amount of) particles not depending on compositions, which may contain particles other than the Cu clusters and can be determined by the small-angle X-ray scattering method, is in good correlation with the SS mark characteristic of the Al—Mg alloy sheet containing Cu. In claims of this application, therefore, the particles determined by the small-angle X-ray scattering method are intentionally not specified as Cu clusters. The atom probe method is a known approach using a 3D atom probe field ion microscope (3DAP), by which an atom type, the number of atoms, and an interatomic distance of an atom cluster can be analyzed.

When Cu is selected as an element having the effect of suppressing SS mark formation in place of Zn that tends to cause age hardening at room temperature, the effect of suppressing SS mark formation is given without causing age hardening at room temperature unlike Zn. However, even if an Al—Mg alloy sheet contains Cu, the sheet may not exhibit the effect of suppressing SS mark formation, and even Al—Mg alloy sheets having the same Cu content (hereinafter, sometimes referred to as Al—Mg—Cu alloy sheet) may be greatly different in the effect of suppressing SS mark formation. Hence, while it is necessary that the Al—Mg alloy sheet contains Cu, it is further necessary to understand the microstructure state, which greatly affects an SS mark formation state, of the Al—Mg alloy sheet.

For the microstructure state, the inventors have speculated that the effect of suppressing SS mark formation is greatly affected by the existing state (such as abundance, presence or absence, and a dispersed state) of the particles in the Al—Mg alloy sheet containing Cu. However, since such particles are each too small, existence of the particles cannot be directly determined by typical microstructure observation. The particles each have a small size of nano level or less as with the Al—Mg-based intermetallic compound in PTL 2 or 3. Consequently, the particles cannot be specified by a typical microstructure observation method such as analysis using SEM or TEM. Based on this, the invention defines the existing state of the particles in terms of the particle size distribution (average particle diameter and volume fraction) of the particles (Cu clusters) determined by the small-angle X-ray scattering method.

(Small-Angle Scattering Method with X-Rays)

The small-angle X-ray scattering method has been known in the past as a typical technique for investigating information of a nanometer-order structure. When a substance is irradiated with X-rays, the incident X-rays reflect the information of electron density distribution in the inside of the substance, and scattered X-rays are generated around the incident X-rays. For example, if the substance contains an uneven region of particles or the electron density, the X-rays interfere with one another and scattering occurs due to density fluctuation regardless of whether the substance is crystalline or amorphous. For a metal such as an aluminum alloy, if the aluminum alloy microstructure contains particles such as small precipitates of nanometer order, scattering is observed due to such particles. When X-rays having a wavelength of 1.54 Å generated using a Cu target are used, the scattered X-rays are generated in a measured-angle 2θ range from about 0.1 to 10 degrees. In the small-angle X-ray scattering method, it is possible to obtain information of the nanometer-order particles, such as a shape, size, and distribution, through analysis of the scattered X-rays. For example, Japanese Unexamined Patent Application Publication No. 2011-38136 uses the small-angle X-ray scattering method in order to determine the average particle diameter and the number density of peak sizes in particle size distribution relating to formation of a stretcher strain mark during press forming of the 5000-series Al—Mg alloy sheet.

(Method of Obtaining Particle Size Distribution)

First, a scatter intensity profile of X-rays of an aluminum alloy sheet is obtained through determination by the small-angle X-ray scattering method in order to determine the average particle diameter in the particle size distribution and the volume fraction thereof in the aluminum alloy microstructure defined in the invention. For example, the scatter intensity profile of X-rays is obtained as a profile with a vertical axis indicating scatter intensity of X-rays (scatter intensity of scattered X-rays), and a horizontal axis indicating a wave vector q ($nm^{-1}$) that varies depending on a measurement angle 2θ and a wavelength λ. The average particle diameter in the particle size distribution and the volume fraction thereof can be obtained from the scatter intensity profile.

Specifically, fitting is performed using a nonlinear least-square method such that measured X-ray scatter intensity is approximate to the X-ray scatter intensity calculated from a theoretical formula represented by a function of particle diameter and size distribution, thereby the particle diameter and the variance can be obtained. The volume fraction of the particles can be obtained as follows: a scatter intensity profile of an object is normalized using a concurrently measured scatter intensity profile of a substance of which the precipitated amount is known, and then the volume fraction is obtained from the scatter intensity derived from the precipitated substance.

For example, a known analysis method by Schmidt et al. (see I. S. Fedorovaand P. Schmidt: J. Appl. Cryst. 11, 405, 1978) is used as such an analysis method of analyzing the X-ray scatter intensity profile to obtain the particle size distribution. The volume fraction of the particles is determined based on Hiroshi Okuda: Microstructures in Metallic Alloys Examined by Small-Angle Scattering (SAS) (An Introduction to the Crystallographer's World), Journal of the Crystallographic Society of Japan, 41, 6 (1999).

(Particle Diameter and Volume Fraction of Particles)

In the invention, as guidelines for indicating a relationship between the microstructure and press formability of the Al—Mg alloy sheet containing Cu, an average particle diameter in particle size distribution determined by the small-angle X-ray scattering method is 0.5 to 6.0 nm, and the volume fraction thereof is 0.03% or more.

Thus, in the invention, a certain amount (certain volume fraction) or more of particles, which have a size (average particle diameter) in a certain range determined by the small-angle X-ray scattering method, are contained in the microstructure of the Al—Mg alloy sheet containing Cu. Consequently, the effect of increasing the limit strain amount is enhanced, so that serrations on the stress-strain curve is suppressed, and the parallel band caused by the serrations is suppressed, and consequently formation of the stretcher strain mark is suppressed.

The volume fraction refers to a ratio of the total volume of all the detected particles (detectable particles) to the volume of the aluminum alloy sheet (volume of the entire aluminum alloy sheet). The producible limit (upper limit) of the volume fraction is about several percent, and further increasing the number density is difficult in manufacturing of the Al—Mg alloy sheet containing Cu. Hence, a preferred upper limit of the volume fraction is defined to be 10%.

For the average particle diameter of less than 0.5 nm in the particle size distribution, size (particle size) is too small; hence, the effect of increasing the limit strain amount is substantially not exhibited, and the effect of suppressing formation of the stretcher strain mark is not exhibited.

For the average particle diameter of more than 6.0 nm in the particle size distribution, size (particle size) is too large; hence, the effect of increasing the limit strain amount is also substantially not exhibited, and the effect of suppressing formation of the stretcher strain mark is not exhibited.

For the volume fraction of the particles of less than 0.03%, the amount of particles effective for increasing the limit strain amount is insufficient; hence, the effect of increasing the limit strain amount is substantially not exhibited, and the effect of suppressing formation of the stretcher strain mark is not exhibited.

The invention also prevents formation of a random mark as the first type of the SS mark due to occurrence of yield elongation. Consequently, it is not necessary to take a previous measure to add a pre-strain (pre-working) for preventing the formation of the random mark. In other words, it is possible to sufficiently suppress both types of the stretcher strain mark (SS mark), i.e., the random mark formed in a region of a relatively small amount of strain and the parallel band formed in a region of a relatively large amount of strain while the previous pre-strain is not added (pre-working is not performed).

Even if a demand level for a surface texture becomes strict more and more particularly in the outer panel, the appearance of which is a commercially important factor, as a material sheet for auto panels, the invention can suppress formation of both the random mark caused by yield elongation and the parallel band relating to serrations on the stress-strain curve. As a result, performance of the material sheet for auto panels can be greatly improved.

(Chemical Composition)

The chemical composition of the aluminum alloy sheet for forming basically corresponds to an aluminum alloy corresponding to JIS 5000-series Al—Mg alloy.

The invention must satisfy various properties of a material sheet, particularly a material sheet to be formed into auto panels, such as press formability, strength, weldability, and corrosion resistance. Hence, the alloy sheet of the invention is specified to be an Al—Mg alloy sheet, which contains, by mass percent, Mg: 2.0 to 6.0%, and Cu: more than 0.3% and 2.0% or less, with the remainder consisting of Al and inevitable impurities, of the 5000 series aluminum alloy. The content of each element is represented by mass percent.

As described above, Zn as an impurity element causes age hardening at room temperature, and degrades bendability and press formability; hence, the Zn content is intentionally minimized. When Zn is contained, the Zn content is limited to, by mass percent, less than 1.0%, preferably 0.6% or less, and more preferably 0.1% or less.

Mg: 2.0 to 6.0%

Mg improves work hardenability and provides strength and durability necessary for the material sheet for auto panels. In addition, Mg allows a material to be deformed uniformly and plastically and thus increases the rupture limit of the material, and thereby improves formability of the material. When the Mg content is less than 2.0%, the material becomes insufficient in strength and durability. When the Mg content exceeds 6.0%, the sheet is difficult to be manufactured, and grain boundary fracture is rather easily caused during press forming, leading to a significant degradation in press formability. Hence, the Mg content is within a range from 2.0 to 6.0%, preferably 2.4 to 5.7%.

Cu: More than 0.3% and 2.0% or Less

Cu forms the clusters of atoms (atom clusters) mainly including Cu, and suppresses the SS mark formation during press forming without causing room-temperature age hardening of the sheet unlike Zn. When the content of Cu is extremely small, 0.3% or less, the formation amount of the clusters mainly including Cu is insufficient, and the effect of suppressing SS mark formation during press forming is insufficiently exhibited. When the content of Cu exceeds 2.0%, the amount of coarse crystallized grains or precipitates, which tend to become fracture origins, is increased, and consequently press formability is rather degraded. The Cu content is within a range from more than 0.3% to 2.0%, preferably from 0.5 to 1.5%.

The content ratio of Cu to Mg, Cu/Mg, is preferably 0.08 to 0.8 in order to allow the addition effect of Cu to be exhibited. The upper limit and the lower limit of this ratio represent a range calculated from a ratio of the preferred upper limits of the Mg content and the Cu content and a ratio of the preferred lower limits thereof.

Other Elements

Other elements exemplarily include Fe, Si, Mn, Cr, Zr, and Ti. Such elements are impurity elements the content of each of which increases with an increase in amount (a ratio with respect to aluminum metal) of aluminum alloy scrap in a form of a melting material. Specifically, if the 5000-series alloy, other Al-alloy scrap materials, and low-purity Al metal are used as ingot materials in addition to high-purity Al metal from the viewpoint of recycling of aluminum alloy sheets, the mixing amount (content) of each of such elements necessarily increases. Decreasing each of the elements to an amount, for example, equal to or lower than the detection limit inevitably increases manufacturing cost; hence, it is necessary to allow the element to be contained in the amount comparable with the typical standard (upper limit) of the 5000-series aluminum alloy, i.e., necessary to define the upper limit of the content of the element.

In this regard, the aluminum alloy sheet is allowed to further contain, by mass percent, one or more elements selected among Fe: 0.5% or less, Si: 0.5% or less, Mn: 0.5% or less, Cr: 0.1% or less, Zr: 0.1% or less, and Ti: 0.05% or less. In addition, boron (B) that tends to be mixed in with Ti is allowed to be contained within a range of less than the Ti content.

(Manufacturing Method)

A method of manufacturing the sheet of the invention is now specifically described.

In the invention, a semifinished product of the sheet can be fabricated up to a rolling step before solution treatment by a method according to a typical manufacturing process of the Al—Mg alloy for forming that contains about 4.5% of Mg, such as alloy of 5182, 5082, 5083, or 5056. Specifically, the semifinished product is fabricated through the typical manufacturing steps of casting (DC casting or continuous casting), homogenization heat treatment, and hot rolling, and is thus formed into an aluminum alloy hot-rolled sheet having a thickness of 1.5 to 5.0 mm. The aluminum alloy hot-rolled sheet in this stage may be used as a product sheet. Alternatively, the hot-rolled sheet may be further cold-rolled while being selectively subjected to one or more times of intermediate annealing before or during the cold rolling, and thus formed into a cold-rolled product sheet having a thickness of 1.5 mm or less.

Solution Treatment:

To produce the sheet having the microstructure of the invention, such a hot-rolled or cold-rolled sheet, which has been produced in the above way so as to have the required thickness, is first subjected to solution treatment-and-hardening treatment with rapid heating and rapid cooling. The material subjected to such solution treatment-and-hardening treatment, so-called T4-treated material, is excellent in balance between strength and formability compared with a batch-annealed material with relatively slow heating and slow cooling. In addition, atomic vacancies are introduced during the hardening treatment following the solution treatment.

An optimum value of the solution treatment temperature must be within a range from 450 to 570° C. while being varied depending on specific alloy components. The material is preferably held at the solution treatment temperature for 180 seconds (3 minutes) or less. If the solution treatment temperature is lower than 450° C., each alloy element is insufficiently dissolved, which may degrade strength, ductility, and the like. If the solution treatment temperature exceeds 570° C., particles are excessively coarsened, leading to a problem of degradation in formability or surface roughening. If the holding time at the solution treatment temperature exceeds 180 seconds, the particles may be excessively coarsened.

Hardening Treatment:

While the sheet is cooled to room temperature in the hardening treatment following the solution treatment, the sheet must be cooled at an average cooling rate of 5° C./s or more from the solution treatment temperature to 200° C. If the average cooling rate from the solution treatment temperature to 200° C. is less than 5° C./s, coarse precipitates are formed during cooling, and even if the sheet is subsequently subjected to low-temperature annealing so as to be formed into a final sheet, the SS mark is formed. This is because the amount of the particles becomes insufficient, and thus the volume fraction does not satisfy 0.03% or more. Such solution treatment-and-hardening treatment with rapid heating and rapid cooling may be continuously performed using forced air cooling in a continuous annealing line (CAL) or forced cooling such as mist cooling or water cooling. The solution treatment-and-hardening treatment may be performed in a batch type using a salt bath or the like for heating, and using water quenching, oil quenching, forced air cooling, or the like for cooling. When the solution treatment-and-hardening treatment is performed using the CAL, each of heating rate and cooling rate between room temperature and the solution treatment temperature is typically about 1 to 30° C./s.

Low-Temperature Annealing:

In the invention, the sheet subjected to the hardening treatment is then aged at room temperature (left at room temperature) for 24 hours or more, and is then subjected to low-temperature annealing that heats the sheet at a temperature of higher than 100° C. and 200° C. or lower. In the low-temperature annealing treatment, the sheet is heated and held for about 0.5 to 48 hours within the temperature range.

If the low-temperature annealing temperature is too low, or if the holding time is too short, the effect of the annealing is not exhibited, and the ultrafine particles are not formed or insufficiently formed after the annealing. Hence, a sufficient amount of particles are not produced only by controlling the cooling rate during the hardening treatment after the solution treatment, and consequently the volume fraction of 0.03% or more is not achieved. As a result, the SS mark formation is probably not prevented.

When the low-temperature annealing treatment is performed at a temperature higher than 200° C., relatively coarse particles are formed instead of the particles by the annealing treatment at such an excessively high temperature, and the average particle diameter in the particle size distribution of the coarse particles does not satisfy 0.5 to 6.0 nm.

The low-temperature annealing treatment is not performed immediately or continuously after the hardening treatment, but is performed after being subjected to room-temperature aging treatment for 24 hours or more, preferably 48 hours or more, following the hardening treatment. The room-temperature aging time refers to time from the end (completion) of the hardening treatment to start of heating of the low-temperature annealing (elapsed or required time).

When the low-temperature annealing is performed following the hardening treatment (with rapid cooling), the low-temperature annealing is typically performed as early as possible after the hardening treatment from the viewpoint of productivity. In the invention, however, the sheet is sufficiently aged at room temperature after the hardening treatment. As a result, the average particle diameter in the particle size distribution can be controlled to be 0.5 to 6.0 nm, and the volume fraction thereof can also be controlled to be 0.03% or more.

Cold Working:

To particularly prevent the random mark as the first type of the SS mark, the sheet of the invention is subjected to cold working (pre-working), which adds a pre-strain with a working rate of about 0.2 to 5% to the sheet, after being subjected to the low-temperature annealing treatment. In this way, the sheet is subjected to the cold working as pre-working while the working rate is adjusted such that an increase in yield strength value is within a specific range, thereby occurrence of yield elongation is steadily suppressed during press forming, so that formation of the SS mark, particularly the random mark, can be surely prevented.

The adding amount of the pre-strain should be similar to that in typical pre-working that is previously performed for preventing formation of the random mark. For example, pre-strain with a working rate of about 0.2 to 5% is added through cold skin-pass rolling, cold rolling, cold repeated-bending by a roller leveler, or the like.

Such a pre-strain is added (cold working is performed), thereby a large number of deformation bands can be actively introduced in the material, and occurrence of yield elongation can be steadily prevented, and consequently formation of the random mark can also be surely prevented in the Al—Mg alloy sheet with particles. If the working rate of the cold working is too small, less than 0.2%, the effect of suppressing formation of the random mark is not exhibited. If the working rate of the cold working is too large to exceed 5%, the yield strength value of the sheet becomes excessively high, and ductility and formability may be rather degraded due to work hardening.

In the invention, the aluminum alloy sheet satisfying the definition of the particles can be manufactured through refining as a combination of the solution treatment condition, the hardening treatment condition, the low-temperature annealing following the room-temperature aging, and the subsequent cold working. Consequently, the Al—Mg alloy sheet containing Cu is enhanced in the effect of increasing the limit strain amount, and thus serrations on the stress-strain curve are suppressed and the parallel band caused by the serrations is suppressed, and thereby formation of the stretcher strain mark is suppressed. In addition, formation of the random mark as the first type of the SS mark caused by occurrence of yield elongation is also suppressed.

Although the invention is now described in detail with an embodiment, the invention should not be limited thereto, and it will be appreciated that modifications or alterations thereof may be made within the scope without departing from the gist described before and later, all of which are included in the technical scope of the invention.

Embodiment

An embodiment of the invention is now described. Al—Mg alloy sheets having the compositions of the inventive examples and the comparative examples as shown in Table 1 were fabricated, and were refined under the conditions shown in Table 2 (continuation of Table 1). The refined sheets were each measured and evaluated in microstructure and mechanical properties.

In Table 1, "–" in the content of an element represents that the content of that element is equal to or lower than the detection limit. In Tables 1 and 2, the same symbols are used, and examples designated by the same symbol are the same examples.

In all the examples, the hot-rolled sheet and the cold-rolled sheet were each fabricated by the same procedure (condition). Specifically, an ingot 50 mm in thickness formed by book mold casting was subjected to homogenization heat treatment for 8 hours at 480° C., and was then hot-rolled at 400° C. As a result, a hot-rolled sheet having a thickness of 2.5 mm was produced. The hot-rolled sheet was cold-rolled into a thickness of 1.35 mm, and the cold-rolled sheet was subjected to intermediate annealing for 10 seconds at 400° C. in a salt bath, and was then cold-rolled into a cold-rolled sheet having a thickness of 1.0 mm.

Such a cold-rolled sheet was subjected to solution treatment and hardening treatment down to room temperature at various conditions shown in Table 2. Subsequently, as shown in Table 2, such formed sheets were subjected to room-temperature aging treatment from the end of the hardening at room temperature to start of heating of low-temperature annealing while the aging treatment time was varied, and were then subjected to the low-temperature annealing treatment while temperature and time conditions were varied. Furthermore, each sheet subjected to the low-temperature annealing treatment was then immediately subjected to cold working for adding a pre-strain to the sheet through skin-pass rolling with a common working rate of 0.5%.

A test specimen (1 mm thick) was cut out from each of the skin-pass-rolled sheets. The test specimen (the sheet that has just refined) was subjected to small-angle X-ray scattering measurement, microstructure measurement, and mechanical property measurement, and were evaluated in such properties within 24 hours after the skin-pass rolling (after the sheet has been finally produced) such that influence of room-temperature aging was not effective (was negligible).

(Small-Angle X-Ray Scattering Measurement)

The small-angle X-ray scattering measurement was performed in common in the examples using the horizontal x-ray diffractometer SmartLab (from Rigaku Corporation) with X-rays having a wavelength of 1.54 Å, so that scatter intensity profile of the X-rays was determined in each example. In the x-ray diffractometer, X-rays are incident perpendicularly onto the surface of a test specimen, and X-rays, which are scattered back from the test specimen at a slight angle (small angle) of 0.1 to 10 degrees with respect to the incident X-rays, are measured using a detector. The test specimen was thinned into about 80 μm for measurement. The small-angle X-ray scattering measurement was performed on an across-the-width section as with a typical measurement site of this type of microstructure. An average of the measured values of five test specimens for measurement, which were sampled from appropriate places (five measurement places) in the across-the-width section of the sheet immediately after the refining, was obtained to determine each of the average particle diameter and the volume fraction (average volume fraction) in the particle size distribution defined in the invention.

The scatter intensity profile of the X-rays was determined using an analysis software including the known analysis method by Schmidt et al., i.e., particle size and pore size analysis software NANO-Solver [Ver. 3.5] by Rigaku Corporation. Fitting was performed by a nonlinear least-square method such that the measured X-ray scatter intensity was approximate to the X-ray scatter intensity calculated with the analysis software, so that the average particle diameter (Cu clusters) was obtained. The average particle diameter was obtained as follows: assuming that each particle had a perfect spherical shape, scatter intensity was calculated using a theoretical formula, and the calculated value was fitted with the experimental value to determine the average particle diameter.

The volume fraction of the particles (Cu clusters) was obtained as follows: a scatter intensity profile of a standard sample of which the precipitated amount was known was used to normalize the scatter intensity derived from the particles (Cu clusters), and then the scatter intensity derived from the particles was integrated to determine the volume fraction. Assuming that the particles were clusters of Cu atoms, the electron density of the particles was obtained based on that of pure copper to calculate a difference in electron density with respect to the aluminum parent phase.

(Mechanical Properties)

A tensile test was performed to investigate the mechanical properties of the test specimen, and tensile strength and elongation were each measured. According to the test condition, a JIS Z2201 No. 5 test piece (25 mm×50 mm gage length (GL)×thickness) was taken from the test specimen in a direction perpendicular to the rolling direction, and was subjected to the tensile test. The tensile test was conducted at room temperature, according to JIS Z2241 (1980) (Method of tensile test for metallic materials). The tensile test was conducted at a constant cross head speed of 5 mm/min until the test piece was ruptured.

(Properties of Sheet after Aging Variation at Room Temperature)

To evaluate aging variation during holding at room temperature (influence of room-temperature age hardening), the test specimen was further held for one month at room temperature, and was then subjected to a tensile test under the same condition to determine an increased amount of tensile strength (amount of room-temperature age hardening) from the end of the refining treatment (from the end of fabrication). While a smaller amount of room-temperature age hardening is better, the increased amount of tensile strength per month is preferably 10 MPa or less as a rough guide.

(Evaluation of SS Mark Formation)

In evaluation of the SS mark formation, the test specimen was also further held for one month at room temperature and then the SS mark formation state was evaluated in consideration that the fabricated sheet was held for a certain period before being subjected to press forming. For this evaluation, the test specimen was held for one month at room temperature, and then subjected to the tensile test to investigate the limit strain amount (critical strain amount (%)) for occurrence of the saw-toothed serrations on the stress-strain curve. Although this embodiment does not actually (directly) check the SS mark (SS mark formation) on a press-formed sheet, the critical strain amount for serrations is in good correlation with the SS mark formation state of the actually press-formed sheet. In this way, as a guideline for indicating formability of an aluminum alloy sheet, such as the SS mark formation state, the critical strain for occurrence of serrations on the stress-strain curve of the aluminum alloy sheet is preferably 8% or more. The upper limit of the critical strain amount cc (limit strain amount) is estimated to be, but not limited to, about 20% in light of limitations in manufacturing, or the like.

(Evaluation of Press Formability)

A stretch forming test was conducted to evaluate stretch formability as an issue of the outer panel. In the stretch forming test, in consideration that the fabricated sheet was held for a certain period before being subjected to press forming, the test specimen was also further held for one month at room temperature, and then the stretch forming test was conducted at a forming speed of 4 mm/s, with a blank holder load of 200 kN, and at a stroke of 20 mm while a spherical-head stretch punch 101.6 mm in diameter was used, rust prevention-and-cleaning oil R-303P (from SUGIMURA Chemical Industrial, Co., Ltd.) was applied as a lubricant onto a test piece 180 mm long and 110 mm wide, and a crack occurring state was visually observed. The test specimen was evaluated as ○ for no crack occurrence during press forming, and as x for crack occurrence in a partial or the entire region.

As seen in Table 1, each of the inventive examples 1 to 8 contains Cu, but does not contain Zn or is limited in Zn content, and thus satisfies the composition of the Al—Mg alloy defined in the invention. As seen in Table 2, such inventive examples are each manufactured under a preferred manufacturing condition as a special combination of the above-described solution treatment-and-hardening treatment, pre-strain, room-temperature aging, and low-temperature annealing. As a result, as seen in Table 2, the microstructure of the Al—Mg alloy sheet containing Cu is successfully controlled such that an average particle diameter in particle size distribution determined by a small-angle X-ray scattering method is 0.5 to 6.0 nm, and the volume fraction thereof is 0.03% or more as defined in the invention.

Consequently, as seen in Table 2, each of the inventive examples is small in increased amount of tensile strength (good in room-temperature aging characteristic, i.e., small in amount of room-temperature age hardening) from the end of fabrication, and is good in press formability including the SS mark characteristic. Specifically, the inventive examples each have a critical strain of 8% or more for occurrence of serrations on the stress-strain curve of the aluminum alloy sheet, some of which have a high critical-strain of 10% or more, and each show no crack occurrence even in the stretch forming test. In addition, such a good SS mark characteristic is successfully achieved without reducing a good mechanical property level including tensile strength and elongation of the 5000-series aluminum alloy sheet including JIS 5052 alloy and JIS 5182 alloy, and without room-temperature age hardening.

However, the inventive example 8, which contains a relatively large amount, 0.6%, of Zn though within the allowable range, is inferior in room-temperature aging characteristic though within the allowable range compared with the inventive examples 3 and 6 having low Zn contents of 0.03% and 0.02%, respectively, and compared with other inventive examples containing no Zn.

In each of the comparative examples 9 to 14, as seen in Table 2, although the alloy composition of the sheet is substantially the same as that of the inventive example 2, the manufacturing condition thereof is out of the preferred range. The comparative example 9 is too low in solution treatment temperature. The comparative example 10 is too low in cooling rate in the hardening treatment. The comparative example 11 is too short in holding time of the room-temperature aging from the end of hardening to start of the low-temperature annealing. The comparative example 12 is too short in holding time of the low-temperature annealing. The comparative example 13 is too low in low-temperature annealing temperature. The comparative example 14 is too high in low-temperature annealing temperature.

As a result, as seen in Table 2, the comparative examples 9 to 14 each do not satisfy the particle size distribution defined in the invention. Hence, although the mechanical properties such as strength and elongation are not greatly different from those of each inventive example, the critical strain for occurrence of serrations on the stress-strain curve of the aluminum alloy sheet is low, less than 8%, and the SS mark characteristic is significantly worse than that of the inventive example. In other words, the comparative examples each have a microstructure that tends to cause the serrations.

In each of the comparative examples 15 to 18, as seen in Table 2, although the manufacturing condition of the sheet is within the preferred range, the alloy composition thereof is out of the range of the invention. The comparative example 15 does not contain Cu. The comparative example 16 is too high in Mg content. The comparative example 17 is too low in Cu content. The comparative example 18 is too high in Zn content.

As a result, as seen in Table 2, each of the comparative examples 15 and 17, which do not exhibit the effect of Cu, does not satisfy the particle size distribution defined in the invention although it is manufactured under a preferred condition. Hence, although the amount of room-temperature age hardening is small, strength is low, and the critical strain for occurrence of serrations on the stress-strain curve of the aluminum alloy sheet is small, less than 8%, and the SS mark characteristic is significantly worse than that of each inventive example. In other words, the comparative examples each have a microstructure that tends to cause the serrations.

The comparative example 16 is too high in strength and is small in elongation, and shows crack occurrence during press forming, i.e., is inferior in press formability compared with the inventive example.

The comparative example 18 is too high in Zn content, resulting in a large amount of room-temperature age hardening beyond the allowable range. Hence, the comparative example 18 shows crack occurrence during press forming, i.e., is inferior in press formability compared with the inventive example.

The above-described embodiment supports the critical meaning of the requirements of the invention or the preferred manufacturing condition for providing the SS mark characteristic, the press formability, and the mechanical properties.

TABLE 1

| | | Chemical composition of Al—Mg alloy sheet (mass %, the remainder Al) | | | | | | | | | |
|---|---|---|---|---|---|---|---|---|---|---|---|
| Classification | Number | Mg | Cu | Fe | Si | Mn | Zn | Cr | Zr | Ti | Cu/Mg ratio |
| Inventive | 1 | 4.5 | 0.5 | — | — | — | — | — | — | — | 0.11 |
| example | 2 | 4.4 | 0.5 | 0.2 | 0.2 | 0.01 | — | 0.01 | — | 0.03 | 0.11 |

TABLE 1-continued

| Classification | Number | Chemical composition of Al—Mg alloy sheet (mass %, the remainder Al) | | | | | | | | | |
|---|---|---|---|---|---|---|---|---|---|---|---|
| | | Mg | Cu | Fe | Si | Mn | Zn | Cr | Zr | Ti | Cu/Mg ratio |
| | 3 | 4.5 | 1.1 | 0.2 | 0.1 | 0.02 | 0.03 | — | — | 0.02 | 0.24 |
| | 4 | 4.5 | 1.8 | 0.1 | 0.2 | — | — | 0.1 | 0.01 | 0.02 | 0.40 |
| | 5 | 4.0 | 0.7 | 0.1 | 0.4 | 0.01 | — | 0.02 | — | 0.02 | 0.18 |
| | 6 | 5.8 | 0.7 | 0.4 | 0.2 | — | 0.02 | 0.01 | — | 0.02 | 0.12 |
| | 7 | 2.6 | 0.4 | 0.1 | 0.1 | 0.3 | — | — | 0.02 | 0.02 | 0.15 |
| | 8 | 4.7 | 0.5 | 0.1 | 0.1 | 0.05 | 0.6 | — | — | 0.02 | 0.11 |
| Comparative example | 9 | 4.4 | 0.5 | 0.2 | 0.2 | 0.01 | — | 0.01 | — | 0.02 | 0.11 |
| | 10 | 4.4 | 0.5 | 0.2 | 0.2 | 0.01 | — | 0.01 | — | 0.02 | 0.11 |
| | 11 | 4.4 | 0.5 | 0.2 | 0.2 | 0.01 | — | 0.01 | — | 0.02 | 0.11 |
| | 12 | 4.4 | 0.5 | 0.2 | 0.2 | 0.01 | — | 0.01 | — | 0.02 | 0.11 |
| | 13 | 4.4 | 0.5 | 0.2 | 0.2 | 0.01 | — | 0.01 | — | 0.02 | 0.11 |
| | 14 | 4.4 | 0.5 | 0.2 | 0.2 | 0.01 | — | 0.01 | — | 0.02 | 0.11 |
| | 15 | 4.5 | — | 0.1 | 0.2 | 0.4 | — | 0.03 | — | 0.02 | — |
| | 16 | 6.8 | 0.7 | 0.4 | 0.1 | — | 0.01 | — | 0.03 | 0.01 | 0.10 |
| | 17 | 4.5 | 0.2 | 0.1 | 0.4 | — | — | — | 0.01 | 0.02 | 0.04 |
| | 18 | 4.5 | 0.5 | 0.2 | 0.2 | 0.1 | 1.5 | — | — | 0.01 | 0.11 |

TABLE 2

| Classification | Number | Solution treatment | | | Room-temperature aging treatment | Low-temperature annealing | | Particle size distribution of sheet microstructure by small-angle scattering | |
|---|---|---|---|---|---|---|---|---|---|
| | | Temperature ° C. | Holding time seconds | Cooling rate in hardening ° C./s | Holding time h | Annealing temperature ° C. | Holding time h | Average particle diameter nm | Volume fraction % |
| Inventive example | 1 | 540 | 300 | 25 | 168 | 150 | 24 | 1.0 | 0.05 |
| | 2 | 540 | 60 | 25 | 72 | 180 | 4 | 1.1 | 0.06 |
| | 3 | 510 | 120 | 25 | 216 | 120 | 36 | 2.9 | 0.09 |
| | 4 | 470 | 150 | 50 | 48 | 150 | 8 | 4.3 | 0.11 |
| | 5 | 530 | 60 | 10 | 240 | 180 | 4 | 1.2 | 0.07 |
| | 6 | 520 | 90 | 10 | 192 | 200 | 2 | 1.4 | 0.07 |
| | 7 | 560 | 60 | 10 | 24 | 120 | 48 | 0.8 | 0.04 |
| | 8 | 480 | 120 | 25 | 480 | 150 | 24 | 1.2 | 0.05 |
| Comparative example | 9 | 420 | 60 | 25 | 168 | 150 | 24 | 2.5 | 0.02 |
| | 10 | 540 | 60 | 3 | 216 | 150 | 24 | 1.9 | 0.02 |
| | 11 | 540 | 60 | 25 | 15 | 150 | 24 | 1.1 | 0.02 |
| | 12 | 540 | 60 | 25 | 240 | 150 | 0.2 | 0.9 | 0.02 |
| | 13 | 540 | 60 | 25 | 72 | 70 | 24 | 0.8 | 0.01 |
| | 14 | 540 | 60 | 25 | 72 | 250 | 24 | 7.7 | 0.12 |
| | 15 | 570 | 60 | 10 | 24 | 150 | 24 | — | 0 |
| | 16 | 480 | 120 | 10 | 192 | 150 | 24 | 1.4 | 0.07 |
| | 17 | 540 | 90 | 25 | 72 | 180 | 4 | 1.0 | 0.02 |
| | 18 | 510 | 60 | 25 | 72 | 120 | 36 | 1.2 | 0.06 |

| Classification | Number | Sheet properties | | | | |
|---|---|---|---|---|---|---|
| | | Critical strain for serrations % | Tensile strength MPa | Elongation % | Room-temperature aging characteristic Increased amount of tensile strength (MPa) | Press formability |
| Inventive example | 1 | 9 | 280 | 32 | 0 | ○ |
| | 2 | 9 | 288 | 31 | 2 | ○ |
| | 3 | 11 | 300 | 30 | 2 | ○ |
| | 4 | 13 | 320 | 29 | 1 | ○ |
| | 5 | 10 | 302 | 30 | 1 | ○ |
| | 6 | 9 | 313 | 29 | 3 | ○ |
| | 7 | 8 | 270 | 33 | 1 | ○ |
| | 8 | 10 | 301 | 30 | 6 | ○ |
| Comparative example | 9 | 5 | 267 | 28 | 1 | ○ |
| | 10 | 6 | 270 | 32 | 1 | ○ |
| | 11 | 6 | 284 | 31 | 1 | ○ |
| | 12 | 5 | 283 | 32 | 2 | ○ |
| | 13 | 4 | 261 | 32 | 1 | ○ |

TABLE 2-continued

| | | | | | |
|---|---|---|---|---|---|
| 14 | 5 | 299 | 29 | 1 | ○ |
| 15 | 3 | 245 | 34 | 0 | ○ |
| 16 | 9 | 339 | 25 | 2 | x |
| 17 | 6 | 258 | 33 | 0 | ○ |
| 18 | 12 | 318 | 27 | 27 | x |

INDUSTRIAL APPLICABILITY

As described above, according to the invention, it is possible to provide the Al—Mg alloy sheet for forming, which is suppressed in formation of both the random mark caused by the yield elongation and the parallel band, and thus suppressed in SS mark formation without causing a new problem such as degradation in bendability due to age hardening at room temperature, and thereby improved in press formability into auto panels.

As a result, the Al—Mg alloy sheet is widely used for many applications such as the motorcar, in which the sheet is press-formed to be used.

The invention claimed is:

1. An aluminum alloy sheet, comprising an Al—Mg alloy sheet comprising, by mass percent:

Mg: 2.0 to 6.0%,

Cu: more than 0.3% and 2.0% or less,

Zn: less than 1.0%, and

Al, wherein the Al—Mg alloy sheet comprises particles having an average particle diameter in particle size distribution determined by a small-angle X-ray scattering method of from 0.5 to 4.3 nm, the particles have a volume fraction of 0.03% or more, and the Al—Mg alloy sheet is obtained by a process comprising cooling at an average cooling rate of at least 5° C./s to room temperature after a solution treatment and before a low-temperature annealing treatment;

performing a room temperature aging treatment for at least 24 hours; and performing the low-temperature annealing treatment at a temperature of higher than 100° C. and 200° C. or lower for 0.5 to 48 hours.

2. The aluminum alloy sheet according to claim 1, further comprising, by mass percent, one or more element selected from the group consisting of: Fe: 0.5% or less, Si: 0.5% or less, Mn: 0.5% or less, Cr: 0.1% or less, Zr: 0.1% or less, and Ti: 0.05% or less.

3. The aluminum alloy sheet according to claim 2, further comprising, by mass percent, Zn: 0.6% or less.

4. The aluminum alloy sheet according to claim 2, wherein the aluminum alloy sheet has a critical strain for occurrence of serrations on a stress-strain curve of the aluminum alloy sheet of 8% or more.

5. The aluminum alloy sheet according to claim 2, further comprising, by mass percent, Ti: 0.05% or less, and B in an amount of less than Ti.

6. The aluminum alloy sheet according to claim 1, comprising, by mass percent, Zn: 0.6% or less.

7. The aluminum alloy sheet according to claim 6, wherein the aluminum alloy sheet has a critical strain for occurrence of serrations on a stress-strain curve of the aluminum alloy sheet of 8% or more.

8. The aluminum alloy sheet according to claim 1, wherein the aluminum alloy sheet has a critical strain for occurrence of serrations on a stress-strain curve of the aluminum alloy sheet of 8% or more.

9. The aluminum alloy sheet according to claim 3, wherein the aluminum alloy sheet has a critical strain for occurrence of serrations on a stress-strain curve of the aluminum alloy sheet of 8% or more.

10. The aluminum alloy sheet according to claim 1, comprising, by mass percent, Zn: 0.1% or less.

11. The aluminum alloy sheet according to claim 1, wherein the particles have a volume fraction of 10% or less.

12. The aluminum alloy sheet according to claim 1, wherein a content ratio of Cu to Mg, Cu/Mg, ranges from 0.08 to 0.8.

* * * * *